US005354450A

United States Patent [19]

Tong et al.

[11] Patent Number: 5,354,450

[45] Date of Patent: Oct. 11, 1994

[54] PHOSPHOROTHIOATE COKING INHIBITORS

[75] Inventors: Youdong Tong, Houston; Michael K. Poindexter, Sugar Land, both of Tex.

[73] Assignee: Nalco Chemical Company, Naperville, Ill.

[21] Appl. No.: 44,183

[22] Filed: Apr. 7, 1993

[51] Int. Cl.[5] ..... C10G 9/16

[52] U.S. Cl. ..... 208/48 AA; 585/950; 208/125

[58] Field of Search ..... 208/48 AA, 125; 585/950

[56] References Cited

U.S. PATENT DOCUMENTS

| | | | |
|---|---|---|---|
| 3,531,394 | 9/1970 | Koszman | 208/48 |
| 4,024,048 | 5/1977 | Shell et al. | 208/48 AA |
| 4,024,049 | 5/1977 | Shell et al. | 208/48 AA |
| 4,024,050 | 5/1977 | Shell et al. | 208/48 AA |
| 4,024,051 | 5/1977 | Shell et al. | 208/48 AA |
| 4,105,540 | 8/1978 | Weinland | 208/48 |
| 4,542,253 | 9/1985 | Kaplan et al. | 585/650 |
| 4,728,629 | 3/1988 | Bertus et al. | 502/62 |
| 4,835,332 | 5/1989 | Kisalus | 585/650 |
| 4,842,716 | 6/1989 | Kaplan et al. | 208/48 |
| 4,900,426 | 2/1990 | Kisalus | 208/48 |
| 4,941,994 | 6/1990 | Zetlmeisel et al. | 252/389 |

*Primary Examiner*—Helane Myers

*Attorney, Agent, or Firm*—Robert A. Miller; Daniel N. Lundeen

[57] ABSTRACT

Inhibiting coke formation on heat transfer surfaces used to heat or cool a petroleum feedstock at coke-forming conditions. The heat transfer surfaces are treated with an effective amount of S,S,S-trihydrocarbyl phosphorotrithioate to inhibit coke formation on the heat transfer surfaces. The phosphorotrithioate is essentially free from contributing to corrosion and from producing catalyst-impairing by-products.

19 Claims, 1 Drawing Sheet

PHOSPHOROTHIOATE COKING INHIBITORS

FIELD OF THE INVENTION

The invention relates to an antifouling process for treating heat transfer surfaces which heat or cool various hydrocarbon feedstocks, often in the presence of steam, at conditions tending to promote the formation of coke on the surfaces, and more particularly, to phosphorothioates for use as an antifoulant.

BACKGROUND OF THE INVENTION

Ethylene manufacture entails the use of pyrolysis or cracking furnaces to manufacture ethylene from various gaseous and liquid petroleum feedstocks. Typical gaseous feedstocks include ethane, propane, butane and mixtures thereof. Typical liquid feedstocks include naphthas, kerosene, and atmospheric/vacuum gas oil. When gaseous or liquid hydrocarbon feedstocks are pyrolyzed in the presence of steam, significant quantities of ethylene and other useful unsaturated compounds are obtained. Steam is used to regulate the cracking reaction of saturated feedstocks to unsaturated products. The effluent products are quenched and fractionated in downstream columns, and then further reacted or processed depending on need.

Fouling of cracking furnace coils, transfer line exchangers (TLEs) and other heat transfer surfaces occurs because of coking and polymer deposition. The fouling problem is one of the major operational limitations experienced in running an ethylene plant. Depending on deposition rate, ethylene furnaces must be periodically shut down for cleaning. In addition to periodic cleaning, crash shutdowns are sometimes required because of dangerous increases in pressure or temperatures resulting from deposit buildup in the furnace coils and TLEs. Cleaning operations are carried out either mechanically or by passing steam and/or air through the coils to oxidize and burn off the coke buildup.

A major limitation of ethylene furnace run length is coke formation in the radiant section and transfer line exchangers (TLEs). The coke is normally removed by introducing steam and/or air to the unit which in effect burns off carbonaceous deposits. Since coke is a good thermal insulator, the furnace firing must be gradually increased to provide enough heat transfer to maintain the desired conversion level. Higher temperatures shorten the tube life, and tubes are quite expensive to replace. Additionally, coke formation decreases the effective cross-sectional area of the process gas, which increases the pressure drop across the furnace and TLEs. Not only is valuable production time lost during the decoking operation, but also the pressure buildup resulting from coke formation adversely affects ethylene yield. Run lengths for ethylene furnaces average from one week to four months depending in part upon the rate of fouling of the furnace coils and TLEs. This fouling rate is in turn dependent upon the nature of the feedstock as well as upon furnace design and operational parameters. In general, however, heavier feedstocks and higher cracking severity results in an increased rate of furnace and TLE fouling. A process or additive that could increase run length would lead to fewer days lost to decoking and lower maintenance costs.

Significant effort has been exerted over the past twenty years in developing phosphorus, in numerous forms, as a coke inhibitor. See U.S. Pat. Nos. 3,531,394 to Koszman (phosphoric acid); 4,105,540 to Weinland (phosphate and phosphite mono and diesters); 4,542,253 and 4,842,716 to Kaplan et al. (amine complexes of phosphate, phosphite, thiophosphate and thiophosphite mono and diesters); 4,835,332 to Kisalus (triphenyl phosphine); and 4,900,426 to Kisalus (triphenyl phosphine oxide). Compared with other element-based additives, many of these phosphorus-based antifoulants have performed extremely well with respect to coke suppression in both lab simulations and industrial applications; however, some have yielded detrimental side effects preventing prolonged usage in many situations, e.g., contributing to corrosion, impairing catalyst performance, or the like.

Convection section corrosion has been a problem with many phosphorus-based anticoking additives of the prior art. Along the path of the convection section tubing, conditions are constantly changing. Heated steam and hydrocarbon are typically introduced to the section separately and then mixed well before entering the radiant section. During the numerous passes that the streams experience, separated or mixed, there can be temperatures, pressures, and compositions which enhance the conversion of antifoulants to detrimental corrosive by-products. A product which is an excellent coke suppressant may also be an extremely corrosive species if it accumulates in the convection section.

Once additives pass through the convection, radiant, and TLE sections, they are subject to effluent quench conditions. In a very simplified view, heavy products concentrate in the primary fractionator, water quench tower, caustic tower and/or compressor knock-out drums, while the lighter components are collected in columns downstream of the compressors. Accumulation of coke inhibitors and their cracked by-products is dictated mainly by their physical properties. Briefly, inhibitor by-products with high boiling points are condensed early in the fractionation process while lighter ones progress to the later stages.

Accumulation of antifoulants and/or their by-products in the radiant and TLE coke, primary fractionator, or water quench tower, is for the most part acceptable. These sections process and collect many other heavy products which are quite impure and thus, trace amounts of an additive generally do not have a significant impact.

In contrast, additives and/or by-products that go past the caustic tower and compressor sections can be a significant problem. Past these sections, purity becomes an important issue since the downstream fractionation generally separates the unsaturated products into high purity chemicals. The presence of phosphorus-containing products which might adversely affect the performance of catalysts used to process these lighter components is unacceptable.

Many phosphorus-containing products are good ligands and can adversely affect the catalyst performance. The phosphorus by-product which is of greatest concern is phosphine ($PH_3$). This by-product is extremely low-boiling (−88° C.). In fact, it has basically the same boiling point as acetylene (−84° C.), a hydrocarbon by-product which is often catalytically hydrogenated to the more desired ethylene.

Accordingly, there remains a need for a phosphorus-based anticoking additive for cracking furnaces which is essentially free from contributing to corrosion and from forming catalyst impairing by-products.

SUMMARY OF THE INVENTION

The present invention is a method for the use of a new antifoulant and coke suppressant, trisubstituted phosphorothioate, to reduce fouling in various high temperature applications, including steam cracking furnaces. The phosphorothioate is used to treat heat transfer surfaces used to heat or cool a petroleum feedstock at coke-forming conditions. The heat transfer surfaces are contacted with an effective amount of a phosphorothioate of the formula $(RX)_3P=Y$, wherein X is chalcogen, preferably oxygen, and more preferably sulfur; wherein Y is chalcogen, preferably sulfur, more preferably oxygen, provided that when X is oxygen Y is sulfur; and wherein each R is independently hydrocarbyl, and two or more of R taken together can form a heterocyclic moiety. The heat transfer surfaces can be contacted with the inhibitor in several different ways, including, for example, pretreating the heat transfer surfaces prior to heating or cooling the petroleum feedstock, continuously or intermittently adding a trace amount of the additive to the petroleum feedstock as it is being heated or cooled, adding the phosphorothioate to steam feed which is then mixed with the petroleum feedstock, to the petroleum feedstock itself, or to a feed mixture of the petroleum feedstock and steam, and the like.

Where the petroleum feedstock being heated or cooled is treated with the phosphorothioate, the additive is preferably added at a rate from about 0.1 to about 1000 ppm, on a basis of elemental phosphorus in the phosphorothioate additive, more preferably from about 1 to about 100 ppm, by weight of the petroleum feedstock.

Each R in the foregoing phosphorothioate formula is preferably alkyl, aryl, alkylaryl, or arylalkyl, wherein the phosphorothioate preferably has from 3 to about 45 carbon atoms, and more preferably, each R has from 1 to 15 carbon atoms.

For the purposes of this invention, coke formation is defined as any buildup of coke or coke precursors on the heat transfer surfaces, including convection coils, radiant furnace coils, transfer line exchangers, quench towers, or the like. Other phosphorus-containing compounds have been disclosed in various patents and other references as effective coke formation inhibitors. However, none of the phosphorus compounds provide the same performance as the present phosphorothioates. Performance is based not only on the anticoking agent's ability to suppress and inhibit coke formation, but just as importantly, on being essentially free from causing any harmful side effects associated with many of the prior art additives, such as contributing to corrosion or impairing catalyst performance.

As used herein, petroleum feedstock is used to refer to any hydrocarbon generally heated or cooled at the heat transfer surfaces, regardless of the degree of previous processing, and specifically when used in reference to an ethylene or other cracking furnace, refers to the hydrocarbon before processing, as well as the hydrocarbon during and after processing in the furnace itself, in the TLE, in the quench section, etc. The feedstock can include ethane, butane, kerosene, naphtha, gas oil, combinations thereof, and the like.

DESCRIPTION OF THE INVENTION

Figure 1:
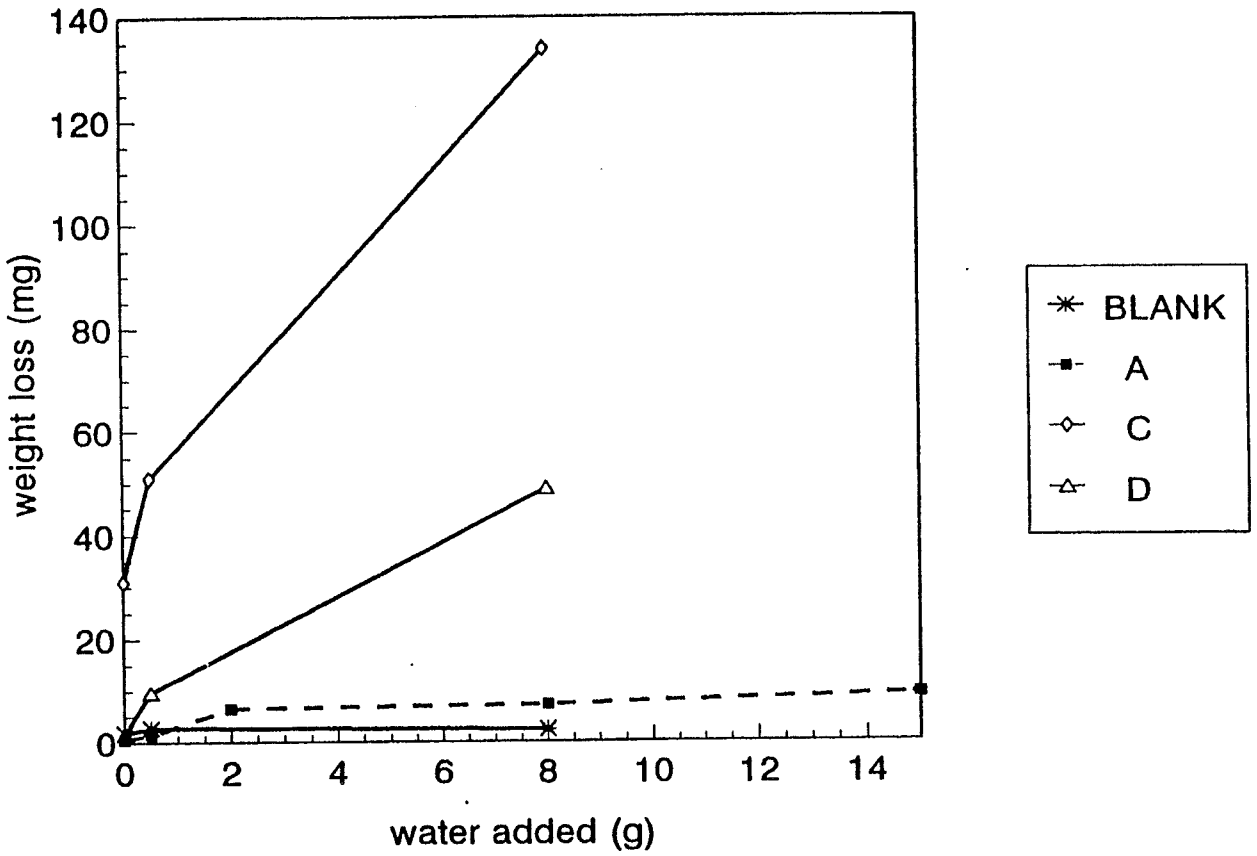
FIG. 1 is a graph illustrating the relative corrosion rates of various phosphorus compounds.

The coking inhibitor of the present invention is a phosphorus and sulfur-based compound which is essentially non-corrosive and is essentially free from phosphine formation under general coking conditions. The present anti-coking agent has the following general formula:

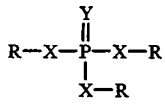

wherein X is chalcogen, preferably oxygen, and especially sulfur; wherein Y is chalcogen, preferably sulfur, and especially oxygen, provided that when X is oxygen, Y is sulfur; and wherein each R is independently hydrocarbyl, such as, for example, alkyl, aryl, alkylaryl, arylalkyl, or the like, and two or more of R taken together can form a heterocyclic moiety. For the purposes of clarity and convenience, and not by way of limitation, the anti-coking agent is referred to herein generally as the preferred S,S,S-trihydrocarbyl phosphorotrithioate, or simply as phosphorotrithioate.

The phosphorotrithioate preferably has from 3 to about 45 carbon atoms and each R group preferably comprises from 1 to 15 carbon atoms. If the number of carbon atoms in the phosphorotrithioate is excessively large, the economics of the additive are less favorable, the additive can lose volatility and miscibility to mix properly in the petroleum feedstock being treated, or can lose the desired stability. The hydrocarbyl groups can be substituted with or contain a heteroatom such as a chalcogen, pnicogen, or the like, but this is generally less preferred because of the concomitant instability imparted by the heteroatom. However, in some situations, where the heteroatom will impart solubility in steam or water, for example, the presence of a heteroatom can be useful, especially where the heteroatom is in a terminal portion of the hydrocarbyl group spaced from the phosphorotrithioate moiety, so that any cleavage or other reaction of the heteroatom will leave the phosphorotrithioate moiety substantially intact for anticoking effectiveness.

The hydrocarbyl group can be the same or different in each thiol moiety, for example, where the phosphorotrithioate is formed from a mixture of different thiols, and/or reacted with different thiols in a stepwise fashion. In of different thiols, and/or reacted with different thiols in a stepwise fashion. In many instances, it is not necessary that the phosphorotrithioate be completely pure, and the reaction product obtained by using isomers or mixtures of thiols, which may be more economically available than the pure thiols, are generally suitable.

Specific representative examples of the anticoking additives include S,S,S-tributyl phosphorotrithioate; S,S,S-triphenyl phosphorotrithioate; and the like.

The phosphorotrithioates are prepared according to methods known in the art, and in some cases are already commercially available. Generally, the phosphorotrithioates can be prepared by the reaction of phosphorus oxyhalide, e.g. phosphorus oxybromide or phosphorus oxychloride, with an excess of thiol in a suitable solvent such as heavy aromatic naphtha, toluene, benzene, etc., with evolution of the corresponding hydrohalide. Bases may also be incorporated to help drive the desired transformation.

The phosphorotrithioate is used to inhibit coke formation on heat transfer surfaces used most often to heat, but sometimes to cool, petroleum feedstocks at coke-forming conditions, by treating the surfaces with an effective amount of the phosphorotrithioate. The surface can be effectively treated, for example, by introducing the phosphorotrithioate into the petroleum feedstock before the feedstock comes into contact with the heat transfer surfaces.

In general, the phosphorotrithioate can be used in an amount effective to obtain the desired inhibition of coke formation, usually at least 0.1 ppm by weight in the hydrocarbon, preferably at least 1 ppm, on a basis of elemental phosphorus. There is usually no added benefit in using the phosphorotrithioate in a relatively high concentration, and the economics are less favorable. Preferably, the phosphorotrithioate is used in an amount from about 0.1 to about 1000 ppm, more preferably from about 1 to about 100 ppm, by weight in the hydrocarbon, or an elemental phosphorus basis.

The addition to the petroleum feedstock is preferably continuous, but it is also possible to use the petroleum feedstock treatment on an intermittent basis, depending on the coke inhibition which is desired in the particular application. For example, where there is a scheduled shutdown of the heat transfer equipment for maintenance, other than for the build up of coke deposits, the continuous addition of the phosphorotrithioate to the petroleum feedstock could be terminated in advance of the shutdown. Or, the anticoking agent could be used in the petroleum feedstock after the development of a pressure drop through the heat transfer equipment indicative of coke formation therein.

It is also possible to treat the heat transfer surfaces before they come into contact with the petroleum feedstock, for example, by applying the phosphorotrithioate as a pretreatment or as a treatment between production runs. As a pretreatment, the phosphorotrithioate can be circulated through the heat transfer equipment, preferably in a suitable diluent. The heat transfer equipment can also be filled with the phosphorotrithioate solution and allowed to soak for a period of time to form a protective film on the heat transfer surfaces. Similarly, the petroleum feedstock can be dosed at a relatively high initial rate, for example, at the beginning of a run, e.g. 0.5 to 2.0 weight percent, and after a period of time, e.g. 1 to 24 hours, reduced to the continuous dosage rates described above.

Where the petroleum feedstock being heated or cooled is being treated on a generally continuous basis, the phosphorotrithioate is preferably added as a solution in a master batch. The mode of blending the phosphorotrithioate with the feedstock is not particularly critical, and a vessel with an agitator is all that is required. However, most conveniently, a master batch of the phosphorotrithioate in a suitable solvent, such as aliphatic or aromatic hydrocarbon, is metered into a stream of the feedstock and intimately mixed therein by turbulence in the processing equipment. Also, the phosphorotrithioate can be added to a steam or water stream which is injected or otherwise added to the petroleum feedstock stream, or the phosphorotrithioate can be added to a mixed stream of the petroleum feedstock and steam or water.

The phosphorotrithioate should be added to the feedstock upstream of the heat transfer surfaces being treated. The phosphorotrithioate addition should be sufficiently upstream to allow sufficient mixing and dispersion of the additive in the feedstock, but preferably not so far upstream so as to avoid or minimize any significant decomposition or degradation of the phosphorotrithioate.

The invention is illustrated by way of the following examples.

EXAMPLES

In the following examples, various phosphorus compounds were evaluated and compared for coke inhibition, corrosivity and phosphine formation. The additives used are designated as indicated in Table 1.

TABLE 1

| ADDITIVE | ACTIVE COMPONENT |
|---|---|
| A | S,S,S-Tributyl phosphorotrithioate |
| B | S,S,S-Triphenyl phosphorotrithioate |
| C | Amine-neutralized phosphate mono/diester* |
| D | O,O,O-Triphenyl phosphate |
| E | Amine-neutralized thiophosphate mono/diester* |
| F | Triphenylphosphine |
| G | Borane-tributylphosphine complex |

*Alkyl groups were $C_6$–$C_{10}$ paraffins; neutralized with morpholine.

All weights and percentages are on a weight basis unless otherwise indicated.

For coke suppression data, a laboratory reactor was used to duplicate conditions in an ethylene furnace as closely as possible. Coke formation was measured on a coupon constructed of 321 stainless steel placed in the lab reactor. To maintain constant cracking conditions, the ethylene to propylene ratio was kept at 2.0. The reaction temperature was about 700° C. throughout each run. Argon was used as a dilution media (5 l/hr). The additive being evaluated was mixed with the hydrocarbon prior to cracking so that the reactor feed had a constant additive content. The coupon was suspended in a vertical run of the furnace from a balance equipped with a digital display and a digital-analog converter to record coking rates. The temperature profile of the reactor was measured off-line using a thermal element inserted inside the reactor tube under identical flow conditions as during the experiment. The recorded reaction temperatures were measured in the isothermal section of the reactor, where the coupon is located. Temperatures at the outer wall of the reactor tube which were continuously monitored during the experiment were approximately 20° C. higher than the recorded reaction temperature. Each coupon was ultrasonically cleaned with acetone. A new coupon was used for each new experiment. After each new coupon was inserted into the reactor tube, the scale was calibrated, the reactor was evacuated several times and flushed with argon to remove traces of air. Coupons were activated by alternate exposure in the reactor tube to cracking conditions with n-heptane for ten minutes and decoking conditions with air until the coke was completely removed. This procedure was repeated several times until the base value of coking rate reached 500–700 μg/min to obtain coking rates which were high enough for comparative testing. The evaporator was heated up to 150° C., and the reactor section to 800° C. and the TLE-part to 500° C. After coupon activation, the temperature in the reactor was adjusted to about 700° C. and ready for additive testing. The effect of an additive was checked in two ways. First, the n-heptane-additive mixture on the precoked surface was tested where the surface had been precoked by feeding pure heptane. Second, the coking rate was evaluated by the heptane-additive mixture on the decoked metallic surface. During that trial, the ethylene-propylene ratio was continuously monitored via an on-line connected gas chromatograph. The additives were evaluated at 100 ppm (approximately 6–8 ppm phosphorus).

EXAMPLE 1

The addition of n-heptane, which contained no additive, was used to establish a coking rate ($R_c$ w/o add, 1st run) under a given set of conditions, i.e., temperature, residence time, etc. Once the coking rate was established over a given time period, the coke formed on the coupon was removed by introduction of air. This same coupon was then subjected to identical conditions, except now an additive had been added to the hydrocarbon. The new coking rate, with additive present ($R_c$ w/add, 2nd run), was recorded over the same time period. After decoking the system again, the same coupon was subjected once again to identical cracking conditions (3rd run), except without the additive. For analysis, the percent reduction in coking rate, due to the additive's presence was taken to be:

$$[1-(R_c \text{ w/add})/(R_c \text{ w/o add})]\times 100\% \quad \text{(Equation 1)}$$

where ($R_c$ w/o add) was the average of those runs without additive. The results are presented in Table 2.

TABLE 2

| ADDITIVE | $R_C$ W/O ADD 1ST RUN (μg/min) | $R_C$ W/ADD 2ND RUN (μg/min) | $R_C$ W/O ADD 3RD RUN (μg/min) | COKE REDUCTION (%) |
|---|---|---|---|---|
| A | 175 | 35 | 294 | 85 |
| B | 160 | 36 | 246 | 82 |

EXAMPLE 2

Continuous addition of n-heptane, which contained no additive, was started and maintained until the coking rate ($R_c$ w/o add) had reached a nearly asymptotic level. Once established, n-heptane containing an additive was switched on and run until an asymptotic rate was reached again. The percent reduction was determined by comparing the coking rate without additive (extrapolated) to that with additive (i.e. Equation 1). Coking reduction results for this procedure are given in Table 3.

TABLE 3

| ADDITIVE | $R_C$ W/ADD (μg/min) | $R_C$ W/O ADD (μg/min) | COKE REDUCTION (%) |
|---|---|---|---|
| A | 28 | 180 | 84 |
| B | 33 | 200 | 84 |

The performance of Additives A and B in both Examples 1 and 2 (Tables 2 and 3) was comparable to the performance of other phosphorus-containing additives described in U.S. Pat. Nos. 4,842,716; 4,835,332; and 4,900,426.

EXAMPLE 3

A high temperature wheel box was used to determine the degradative properties of various additives over long periods of time. To accelerate corrosion effects, Additive A was used at a concentration of 5 percent in n-heptane, and other additives were used at an equivalent phosphorus content. The additive was added to a high alloy vessel along with hydrocarbon, varying amounts of water and preweighed coupons constructed of carbon steel. The contents were rotated continuously at temperatures representative of a typical convection section of an ethylene furnace; the mixing ensured that the coupons would be exposed to both a liquid and a gas phase (composed of water and hydrocarbon). Exposing the additives to high temperature for extended periods of time permitted potential decomposition to harmful by-products. In essence, this method simulated a worse case scenario involving a fairly high concentration of an additive in the convection section with eventual accumulation/degradation (e.g. thermolysis, hydrolysis, disproportionation, etc.) to by-products which may or may not be corrosive. Additionally, the appearance of corrosion may not be the direct result of degradation, but may be an inherent property of an additive. In FIG. 1, test data for Additive A is compared against two other compounds, one of which was an amine-neutralized phosphate ester mono- and di-substituted with alkyl groups, a known coke suppressant with aggressive corrosivity. As can be seen, the S,S,S,-tributyl phosphorotrithioate (A) exhibited excellent performance no matter how much water was present. The same was not true for the other phosphorus-based compounds.

EXAMPLE 4

A lab unit was constructed which would simulate the dynamic (i.e. erosive and corrosive) conditions of a typical convection section of an ethylene furnace. Corrosion is more likely to occur at or near the bends/elbows of the convection sections because of high erosion due to the velocity of the stream. Steam, generated from one vessel, was mixed with hydrocarbon (hexane and toluene at 50-50 weight percent) from a second vessel (steam:hydrocarbon weight ratio 0.5–0.6). Heating to the desired temperature was accomplished by passing the mixture through two independent furnaces held at specified temperatures (100°–600° C.). Both furnaces were monitored and controlled via two separate temperature controllers. Preweighed corrosion coupons, made of carbon steel, were situated at a bend within the furnace coil. Coupon A was situated in the process flow, subjected to the erosive and corrosive nature of the process stream. Coupon B was situated in a dead-leg projecting out of the bend of interest. This positioning permitted the accumulation of corrosive species, but shielded Coupon B from the nearby erosive environment. In essence, Coupon B was situated to study the effects of points where the process flow is extremely dormant (i.e. non-turbulent areas). Thermocouples were used to record the temperature of both coupons as well as both furnace sections.

The additives were added to the hydrocarbon feed and tested under conditions identical to a blank (without additive). Coupon weight loss for several additives is given in Table 4. S,S,S-Tributyl phosphorotrithioate (A), at 2.4 weight percent in the hydrocarbon, gave excellent results compared to the others tested, at an equivalent phosphorus content.

TABLE 4

| ADDITIVE | WEIGHT LOSS (mg) COUPON A | COUPON B |
|---|---|---|
| Blank | 1.1 | 0.0 |
| A | 0.7 | 0.0 |
| C | 10.3 | 0.3 |

TABLE 4-continued

| ADDITIVE | WEIGHT LOSS (mg) COUPON A | COUPON B |
|---|---|---|
| E | 20.0 | 4.3 |

EXAMPLE 5

To determine the propensity of various phosphorus-based products to yield $PH_3$, a known catalyst poison, additives were evaluated in the apparatus described in the Example 4. Additive A was used at 5 weight percent in the hydrocarbon, and all other additives were used at an equivalent phosphorus content. To achieve the proper cracking temperature, a radiant section (750°–950° C.) was added just after the convection section. To more accurately simulate a typical ethylene furnace downstream quenching process, the effluent gases were passed through several vessels maintained at a low temperature (0° C. and −78° C.), a caustic scrubber, and a dryer containing 3 Å molecular sieves. Phosphine production levels given in Table 5 below are relative to each other (Additive F reading =100) and were determined by the colorimetric reading taken from a gas detector situated downstream of all the condensers. A low value indicates little $PH_3$ was produced while higher values indicate larger levels were produced. As a second confirmation that $PH_3$ was being produced by the phosphorus based chemicals, the cracked gas effluent was bubbled through deuterated chloroform at low temperatures (−78° C.) and analyzed by $^{31}$PNMR at −60° C. The spectrum obtained matched $PH_3$ from the literature (−234 ppm, quartet with $J_{PH}$192 Hz).

TABLE 5

| ADDITIVE | RELATIVE $PH_3$ FORMATION RATE |
|---|---|
| A | 0.7 |
| B | 0.4 |
| C | 0.4 |
| F | 100 |
| G | >250 |

From the foregoing data, it is seen that the S,S,S,-trihydrocarbyl phosphorotrithioates evaluated are as effective in coke suppression as the prior art phosphorus-based additives, but are essentially free from contributing to corrosion and from forming phosphine. It is further seen that the other phosphorus-based additives evaluated either contributed to corrosion or formed phosphine under coking conditions.

The foregoing description of the invention is illustrative and explanatory thereof, and not intended in any limiting sense. Various changes in the materials, apparatus, steps, procedures and particular parts and ingredients will occur to those skilled in the art. It is intended that all such variations within the scope and spirit of the appended claims be embraced thereby.

We claim:

1. A method for inhibiting coke formation on heat transfer surfaces used to heat or cool a petroleum feedstock at coke-forming conditions, comprising:

contacting the heat transfer surfaces with an effective amount to inhibit coke formation of a phosphorothioate of the formula $(RX)_3P=Y$ wherein X and Y are chalcogen, provided that when X is oxygen Y is sulfur, and each R is independently an alkyl, aryl, alkylaryl or arylalkyl group having from 1–15 carbon atoms, and two or more of R taken together can form a heterocyclic moiety.

2. The method of claim 1, wherein X is sulfur and Y is oxygen.

3. The method of claim 2, wherein the phosphorotrithioate comprises from 3 to 45 carbon atoms.

4. The method of claim 3, wherein the hydrocarbyls are free of heteroatoms.

5. The method of claim 4, wherein each R is independently alkyl, aryl, alkylaryl or arylalkyl having from 1 to 15 carbon atoms.

6. The method of claim 2, wherein the phosphorotrithioate comprises S,S,S-tributyl phosphorotrithioate.

7. The method of claim 2, wherein the phosphorotrithioate comprises S,S,S-triphenyl phosphorotrithioate.

8. The method of claim 1, wherein the petroleum feedstock being heated or cooled is treated with from 0.1 to 1000 ppm on a basis of elemental phosphorus in the phosphorothioate by weight of the feedstock.

9. The method of claim 1, wherein the petroleum feedstock being heated or cooled is treated with from 1 to 100 ppm on a basis of elemental phosphorus in the phosphorothioate by weight of the feedstock.

10. The method of claim 1, wherein the petroleum feedstock includes ethane, propane, butane, naphtha, kerosene, gas oil, or a combination thereof.

11. The method of claim 1, wherein the heat transfer surfaces comprise cracking furnace coils.

12. The method of claim 1, wherein the heat transfer surfaces comprise transfer line exchangers.

13. The method of claim 1, wherein the heat transfer surfaces are pretreated with the phosphorothioate before heating or cooling the petroleum feedstock.

14. The method of claim 2, comprising:

adding the phosphorotrithioate to a petroleum feedstock; and passing the resulting admixture through convection and radiant sections of a cracking furnace.

15. The method of claim 14, further comprising fractionating the furnace effluent and catalytically treating a fraction thereof.

16. The method of claim 2, comprising:

adding the phosphorotrithioate to a petroleum feedstock or ethylene furnace effluent upstream from a transfer line exchanger; and passing effluent from the cracking furnace containing the phosphorotrithioate through the transfer line exchanger.

17. The method of claim 16, further comprising fractionating the furnace effluent and catalytically treating a fraction thereof.

18. The method of claim 2, comprising:

adding the phosphorotrithioate to steam;

mixing the steam with a petroleum feedstock;

passing the admixture of feedstock and steam containing the phosphorotrithioate through a cracking furance.

19. The method of claim 2, comprising:

adding the phosphorotrithioate to a mixture of steam and a petroleum feedstock; and passing the resulting admixture through a cracking furnace.

* * * * *